US009975751B2

(12) United States Patent
Levy et al.

(10) Patent No.: US 9,975,751 B2
(45) Date of Patent: May 22, 2018

(54) COLLECTION FUNNEL

(71) Applicant: NAVAJO MANUFACTURING COMPANY, INC., Denver, CO (US)

(72) Inventors: Gordon Levy, Golden, CO (US); Shawn Shelton, Denver, CO (US)

(73) Assignee: NAVAJO MANUFACTURING COMPANY, INC., Denver, CO (US)

( * ) Notice: Subject to any disclaimer, the term of this patent is extended or adjusted under 35 U.S.C. 154(b) by 0 days. days.

(21) Appl. No.: 14/822,626

(22) Filed: Aug. 10, 2015

(65) Prior Publication Data

US 2015/0344279 A1 Dec. 3, 2015

Related U.S. Application Data

(63) Continuation-in-part of application No. 13/780,457, filed on Feb. 28, 2013, now Pat. No. 9,284,175.

(60) Provisional application No. 62/104,482, filed on Jan. 30, 2015.

(51) Int. Cl.
*B67C 11/02* (2006.01)

(52) U.S. Cl.
CPC ..... *B67C 11/02* (2013.01)

(58) Field of Classification Search
CPC ..... B67C 11/02
USPC ..... 141/334, 333, 332, 331, 342, 343, 297, 141/329, 319, 340, 337, 341, 367; D15/150; D23/200; D7/700; D9/447, D9/523; 222/85
See application file for complete search history.

(56) References Cited

U.S. PATENT DOCUMENTS 192,987 A 7/1877 Griffiths
478,303 A * 7/1892 Allgood ..... F16N 33/00 141/106
690,576 A * 1/1902 Hesse ..... F17C 5/06 116/228
D59,648 S * 11/1921 Gregory ..... D7/667
1,612,383 A * 12/1926 Lepeshkin ..... B67C 11/02 141/300
1,868,389 A * 7/1932 Howard ..... B67C 11/02 141/367
1,912,283 A * 5/1933 Kronquest ..... B67B 7/26 184/105.1

(Continued)

FOREIGN PATENT DOCUMENTS

GB 612851 11/1948
GB 2 266 251 A 10/1993

*Primary Examiner* — Jason K Niesz
*Assistant Examiner* — James Hakomaki
(74) *Attorney, Agent, or Firm* — Studebaker & Brackett PC

(57) ABSTRACT

A funnel having a collection area disposed at one end of the funnel. A base surface of the collection area is flat. A flange surrounding an inlet opening is positioned spaced from the collection area. When the funnel is placed in a vertical orientation with the base surface of the collection area contacting a horizontal surface, a lowermost edge of the flange surrounding the inlet opening is aligned with the base surface of the collection area. The funnel is thereby supported in a vertical orientation on the horizontal surface by two contact points. Alternately, the base surface of the collection area may support the funnel vertically by itself. In this position, the residual fluid in the funnel is transferred by gravity to collect within the collection area. No residual fluid is allowed to escape from the interior of the funnel.

10 Claims, 17 Drawing Sheets

(56) References Cited

U.S. PATENT DOCUMENTS 2,131,644 A * 9/1938 Sherrell ..... B67B 7/28 222/86
D143,458 S 1/1946 Zabel et al.
3,490,501 A 1/1970 Manem et al.
D218,773 S 9/1970 Sitts
3,537,623 A * 11/1970 Fisher ..... B65D 47/122 222/460
D230,629 S 3/1974 Camp et al.
3,899,012 A 8/1975 Sather
4,245,666 A 1/1981 Norris
D282,807 S 3/1986 Hasse
4,646,795 A 3/1987 Hebron et al.
4,804,026 A 2/1989 Bailey
4,846,236 A * 7/1989 Deruntz ..... B67D 3/0032 141/319
5,092,471 A 3/1992 Pinizzotto et al.
5,105,860 A * 4/1992 Connor ..... B67C 9/00 141/106
D340,460 S 10/1993 Pollak et al.
D340,731 S 10/1993 Pollak et al.
5,280,764 A * 1/1994 Levinrad ..... B67D 3/0032 141/330
5,316,059 A 5/1994 Lahnan et al.
5,385,180 A * 1/1995 Wittman ..... B67C 11/02 141/106
5,497,814 A 3/1996 Cannon
5,607,004 A * 3/1997 Cope ..... B67C 11/00 141/331
D397,002 S * 8/1998 Smith ..... D7/700
5,899,246 A * 5/1999 Cummins ..... B67C 9/00 141/297
D415,662 S 10/1999 Schneider
6,098,678 A 8/2000 Shears
6,142,193 A 11/2000 Sanders
6,179,022 B1 1/2001 Schneider et al.
6,340,038 B1 * 1/2002 Ingram ..... B67C 11/02 141/333
6,450,219 B1 9/2002 Ingram
6,502,711 B1 * 1/2003 Mc Rae ..... B65D 21/0204 211/71.01
D554,166 S 10/2007 Lafollette
D554,349 S 11/2007 Fletcher et al.
D560,106 S 1/2008 Curtin
D593,383 S 6/2009 Pallotto et al.
D599,902 S 9/2009 Lilienthal et al.
D654,766 S 2/2012 Vaders et al.
D661,957 S 6/2012 Lee et al.
D669,750 S 10/2012 Lee et al.
D671,379 S 11/2012 Lion
D690,340 S 9/2013 Levy et al.
D690,752 S 10/2013 Levy et al.
2012/0152408 A1 6/2012 Levy et al.
2014/0137985 A1 * 5/2014 Zitkovic ..... B67C 11/02 141/331

* cited by examiner

COLLECTION FUNNEL

CROSS REFERENCE TO RELATED APPLICATIONS

This application is a continuation-in-part application of Ser. No. 13/780,457, filed Feb. 28, 2013, and claims priority of provisional application 62/104,482, filed Jan. 30, 2015, the entire content of each of which is incorporated herein by reference.

FIELD OF THE INVENTION

The present invention relates to the field of collection of viscous fluids, whether in a kitchen or automobile environment.

BACKGROUND OF THE INVENTION

Often times, a funnel is used to transfer fluids from a container into another receptacle. This may include the transfer of automobile oil to the engine of an automobile. Alternatively, cooking fluids are often times required to be transferred from a large container into a smaller container.

The concept is the same in either environment in that a fluid is transferred by a funnel through a large intake opening into a small outlet opening for communication with a downstream receptacle. When this transfer is complete, the funnel used often collects a residue of fluid between the funnel's larger intake opening and its smaller outlet opening. Unless a cloth or paper towel is used to clean the interior of the funnel, the fluid collects in the funnel and is ultimately allowed to drip from the outlet opening.

This residual fluid then must be dealt with after the fluid has been allowed to be transferred to an unintended location. In addition, if a transfer tube remains connected to the outlet opening, the free end of the tube is also allowed to transfer residual fluid along an unintended path.

SUMMARY OF THE INVENTION

It is therefore an object of the present invention to collect all residual fluid remaining in the interior of a funnel between an inlet opening and an outlet opening.

This object is obtained by a funnel having a collection area disposed at one end of the funnel. A base surface of the collection area is flat. A flange surrounding the inlet opening is positioned spaced from the collection area. When the funnel is placed in a vertical orientation with the base surface of the collection area contacting a horizontal surface, a lowermost edge of the flange surrounding the inlet opening is aligned with the base surface of the collection area. Alternately, the base surface may support the funnel. The funnel is thereby supported in a vertical orientation on the horizontal surface by one or two contact points.

In this position, the residual fluid in the funnel is transferred by gravity to collect within the collection area. No residual fluid is allowed to escape from the interior of the funnel. A hanging opening is provided in the upper portion of the flange for hanging of the funnel on a hook or nail protruding from a vertical surface.

Accordingly, it is another object of the present invention to provide a collection funnel for collecting residual fluid contained between an inlet opening and an outlet opening so as to prevent the escape of residual fluid from the funnel.

It is yet another object of the present invention to provide a collection funnel for collecting residual fluid contained between an inlet opening and an outlet opening so as to prevent the escape of residual fluid from the funnel with the funnel including a collection area at a base portion of the funnel for collecting the residual fluid.

It is still yet another object of the present invention to provide a collection funnel for collecting residual fluid contained between an inlet opening and an outlet opening so as to prevent the escape of residual fluid from the funnel with the funnel including a collection area at a base portion of the funnel for collecting the residual fluid with the collection area defining a base surface to support the funnel in a vertical orientation when the funnel is placed upon a horizontal surface.

It is still yet another object of the present invention to provide a collection funnel for collecting residual fluid contained between an inlet opening and an outlet opening so as to prevent the escape of residual fluid from the funnel with the funnel including a collection area at a base portion of the funnel for collecting the residual fluid with the collection area defining a base surface to support the funnel in a vertical orientation when the funnel is placed upon a horizontal surface with the base surface of the collection area cooperating with a lowermost surface of a flange surrounding the inlet opening to stabilize the funnel in a vertical orientation at two contact points.

These and other objects of the invention, as well as many of the intended advantages thereof, will become more readily apparent when reference is made to the following description taken in conjunction with the accompanying drawings.

BRIEF DESCRIPTION OF THE DRAWINGS

The following drawings illustrate examples of various components of the invention disclosed herein, and are for illustrative purposes only. Other embodiments that are substantially similar can use other components that have a different appearance.

DETAILED DESCRIPTION OF THE PREFERRED EMBODIMENTS

Figure 1:
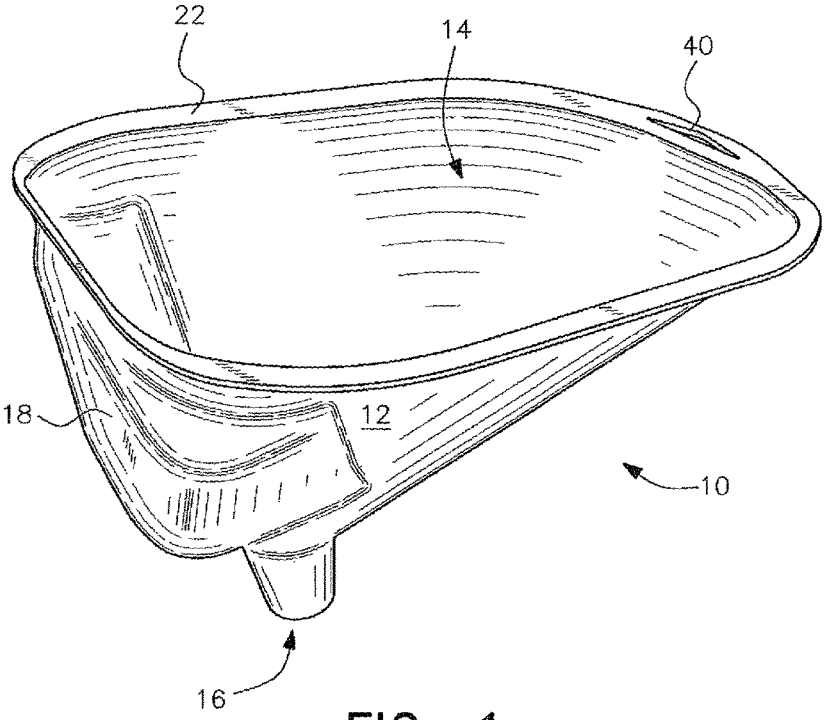
FIG. 1 is a perspective view of the collection funnel of the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
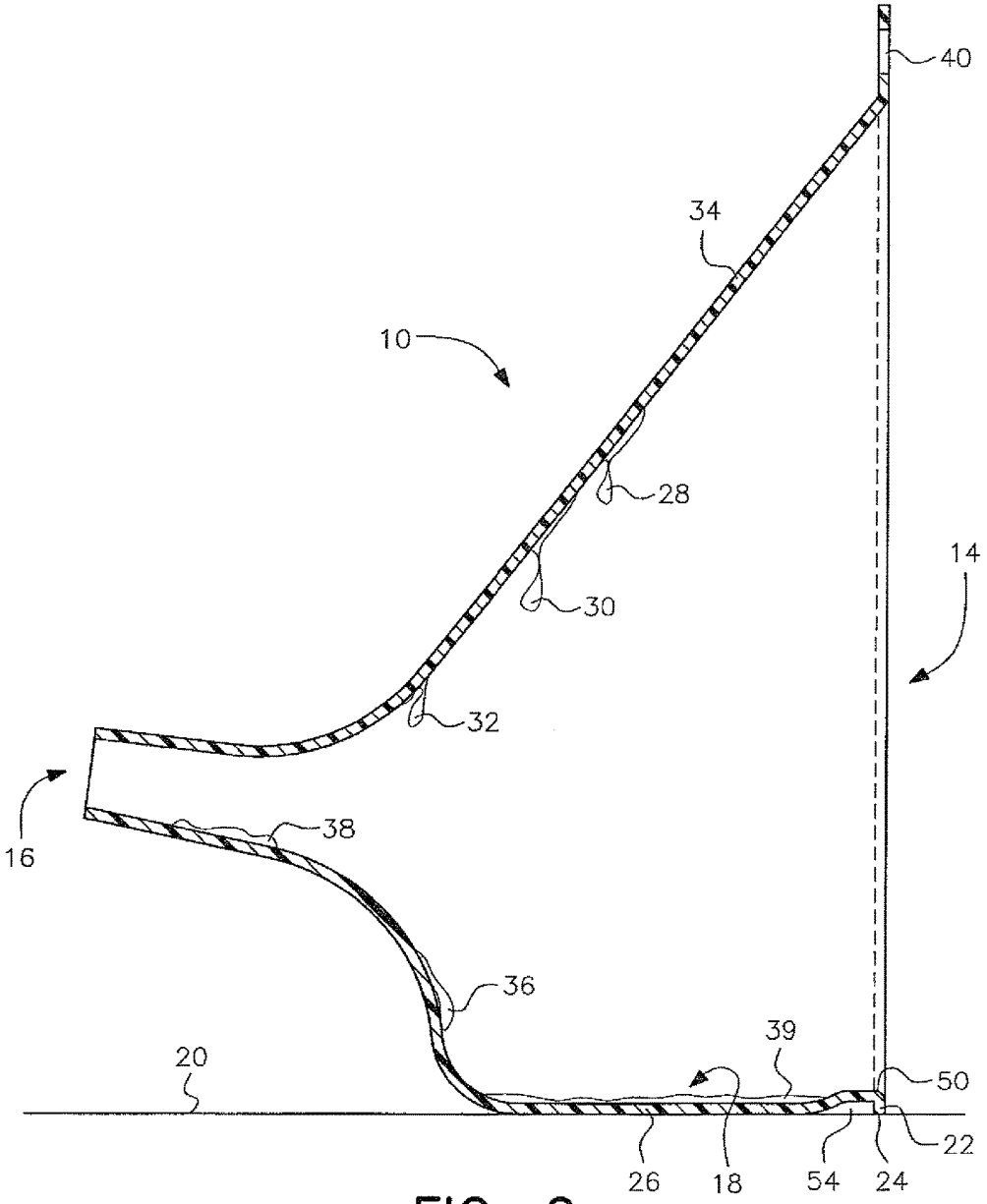
FIG. 2 is a cross-sectional view of the collection funnel illustrating the funnel positioned on a horizontal surface for collection of residual fluid in a collection area.
Figure 3:
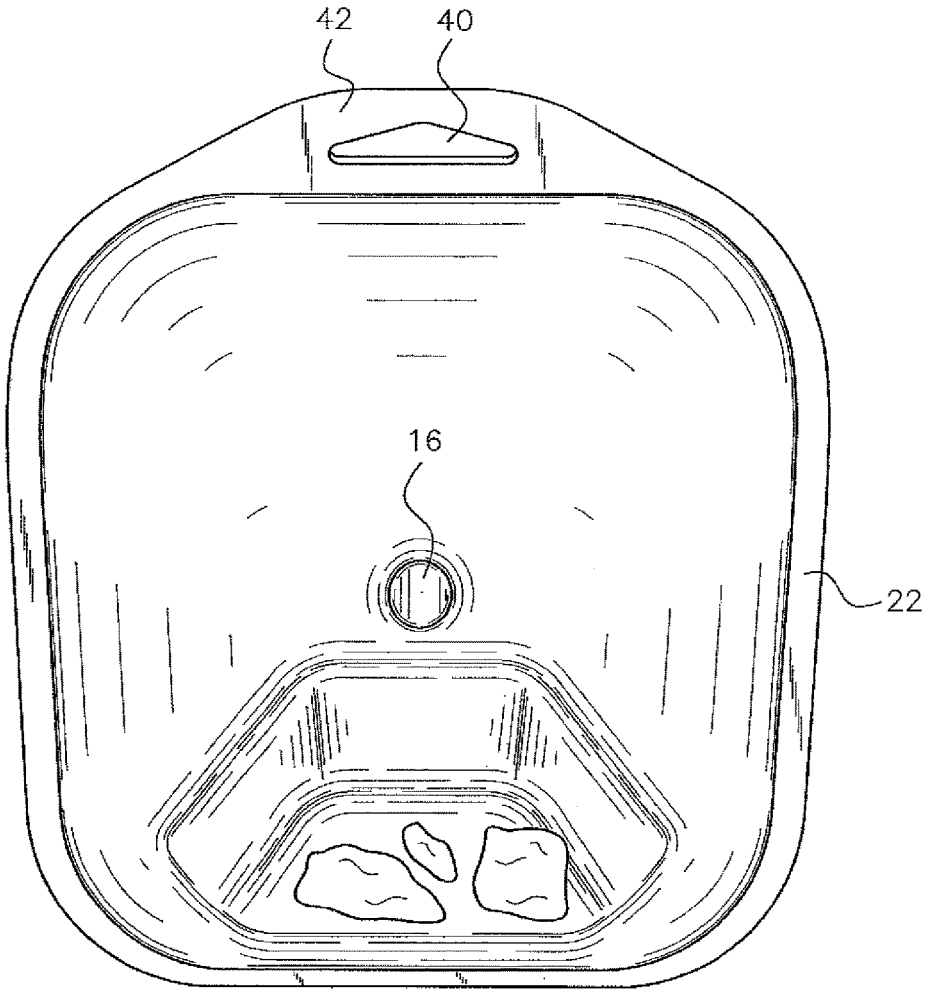
FIG. 3 is a front view of the collection funnel showing the collection of residual fluid in the collection area.
Figure 4:
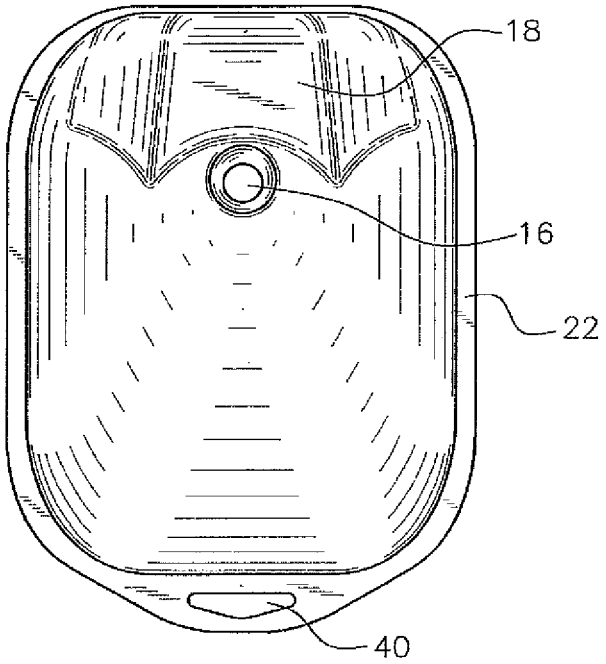
FIG. 4 is a top view of the collection funnel.
Figure 5:
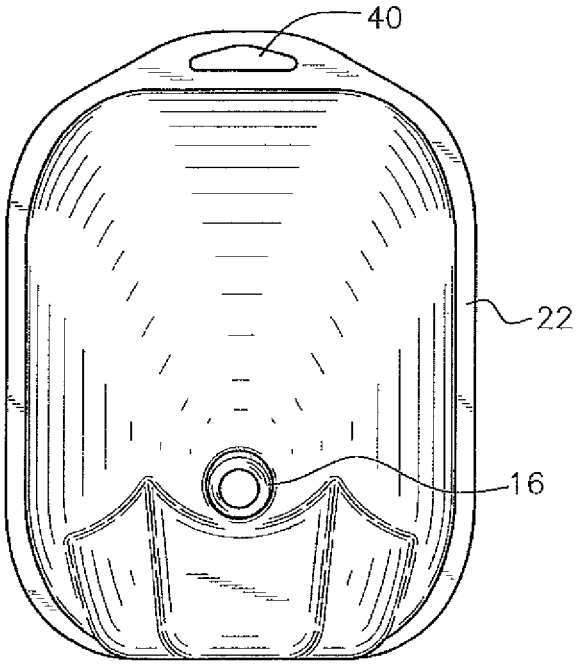
FIG. 5 is a bottom view of the collection funnel.
Figure 6:
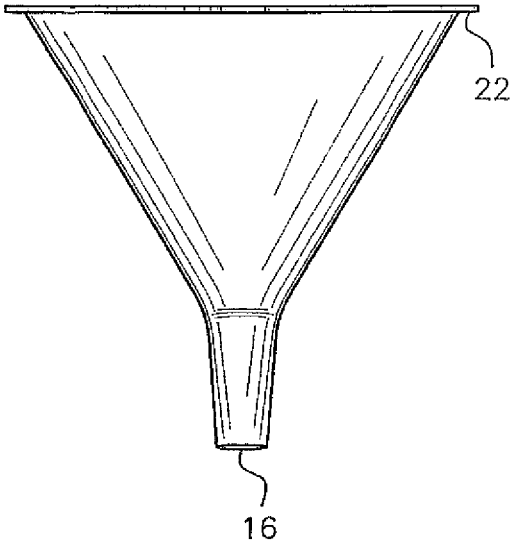
FIG. 6 is a front view of the collection funnel.
Figure 7:
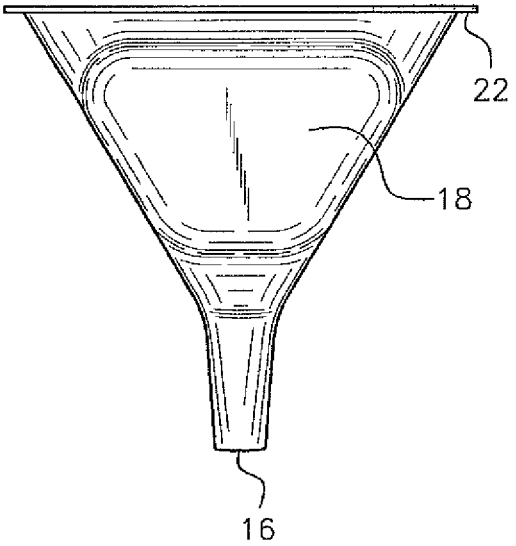
FIG. 7 is a rear view of the collection funnel.

With reference to the drawings, in general, and to FIGS. 1 through 3, in particular, a collection funnel embodying the teachings of the subject invention is generally designated as 10. With reference to its orientation in FIG. 1, the collection funnel includes a body 12 having an inlet opening 14 and an outlet opening 16. Liquids are normally dispensed into the inlet opening 14 and after traveling through the body 12 of the funnel, exit the funnel through outlet opening 16.

As shown in FIG. 2, when the funnel 10 is finished being used, a recessed collection area 18 is positioned on a horizontal surface 20 such as a counter top or working surface. Flange 22, which surrounds the inlet opening 14, includes a lower most edge portion 24 which is also moved into contact with the surface 20, so as to position the funnel in a vertical orientation. A lowermost base surface 26 of the collection area 18 also contacts the surface 20.

The collection area 18 is positioned at one end of the funnel to provide a bumped out portion of a funnel which is used to collect residual fluid in the funnel and stabilize the funnel in a vertical orientation. The depth of the recessed collection area, below an uppermost edge of flange 22 is approximately ¼ to ½ of an inch. The width of the collection area is approximately three inches tapering down to a width of 1½ inches. The sidewalls of the collection area generally follow and are aligned with the converging sidewalls of the remainder of the body.

As shown in FIG. 2, residual fluid droplets 28, 30, 32 move along inclined surface 34 due to the force of gravity. In addition, residual fluid droplets 36, 38 also move along surfaces of the funnel by gravity. These droplets of residual fluid collect as residual fluid mass 39 at the bottom of collection area 18. By this mechanism, no additional steps need be taken to prevent residual fluid from leaking from the funnel located in a supported vertical orientation.

Alternatively, the funnel may be positioned along a vertical surface by passage of a nail or hook through an opening 40 in an upper portion 42 of the flange 22. In this instance, the flange 22, surrounding the inlet opening 14, functions to stabilize the funnel in a vertical orientation against a vertical surface for collection of residual fluid in the collection area 18.

As can be seen in the figures, recessed collection area 18 has a depth of ¼ to ½ inch below the inner edge 50 of flange 22. This forms a recess for collection of a significant quantity of residual fluid, if necessary. By having a narrow gap 54 between the flange 22 and the collection area 18, the funnel 10 is very stable when positioned on a flat horizontal surface. A width of the gap 52 is approximately ½ inch.

In addition, outlet opening 16 is of a conical shape, tapering inwardly from the interior of the funnel towards its opening. A longitudinal axis 50 of the outlet opening is spaced approximately 1½ inches above the bottom surface 26.

The outlet opening is positioned at an angle with respect to the bottom surface 26 of the collection area 18. Typically, the angle of inclination $\propto$ is between 10° and 20°. This assists in the return of residue droplet 38 by gravity to the collection area 18.

Figure 9:
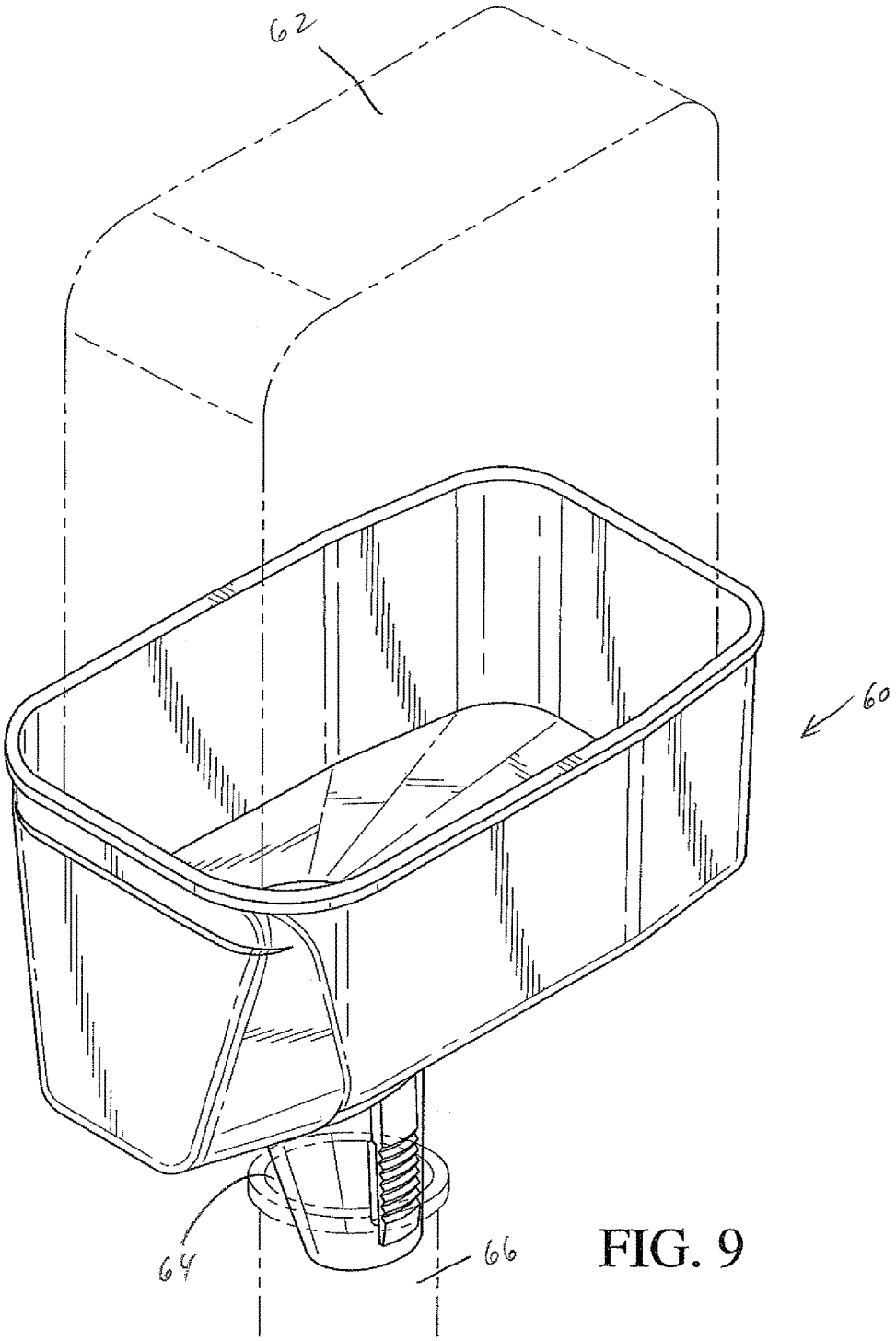
FIG. 9 is a perspective view of a collection funnel of an alternate embodiment of the present invention, shown frictionally mounted in an oil intake opening port of an engine and having an oil container frictionally held within the funnel.

An alternate embodiment of the present invention is shown in FIGS. 9 through 18. In these figures, a collection funnel 60 is used for dispensing liquid from one container into another. Therefore, as shown in FIG. 9, the collection funnel 60 is shown holding one container 62 and dispensing the liquids from container 62 into an inlet 64 of a container 66. The advantages of the collection funnel 60 are the same as the collection funnel 10 in the prior figures. In FIG. 9, container 62 is a quart of motor oil and inlet 64 is an oil port of an automobile engine.

Figure 10:
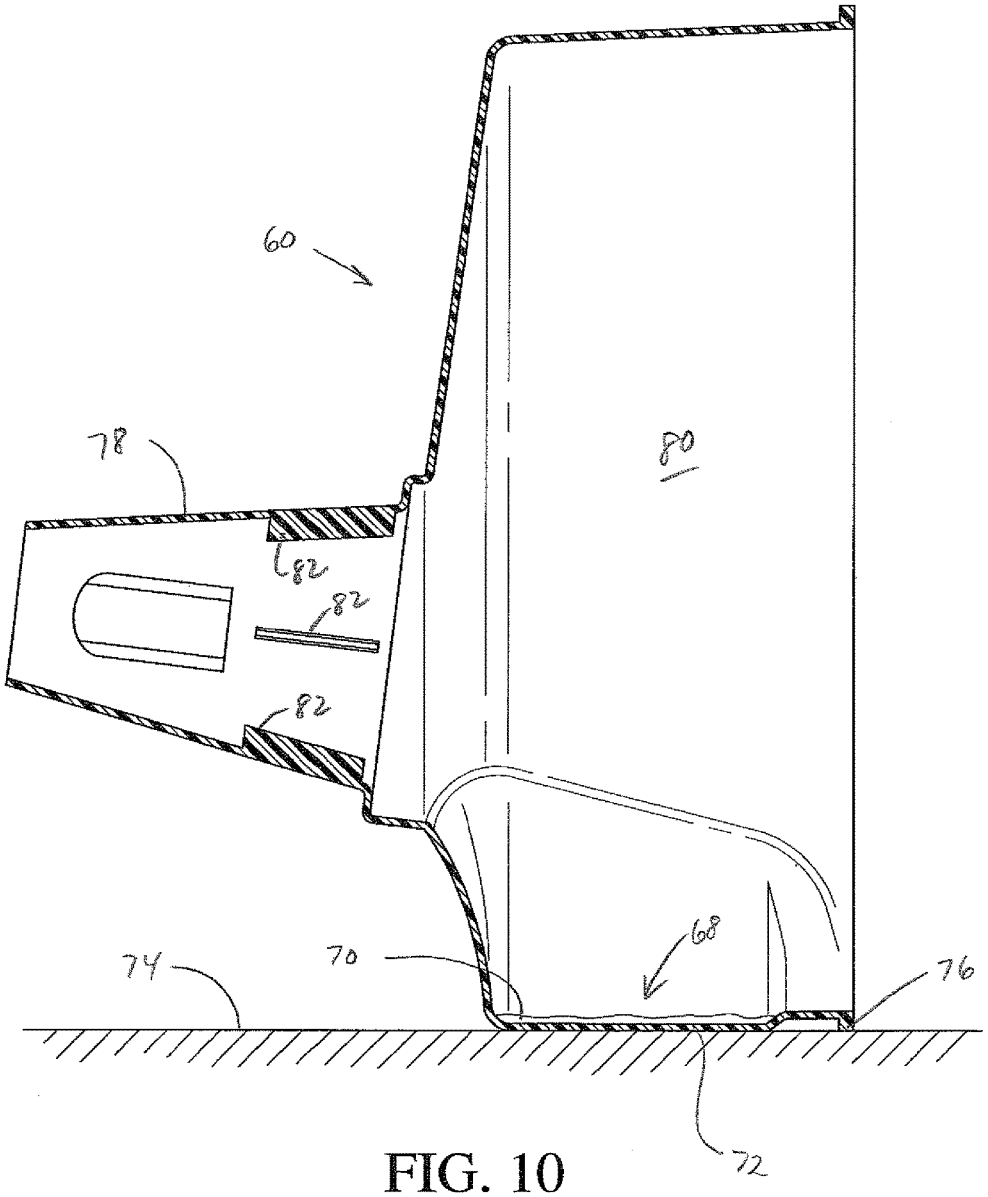
FIG. 10 is a cross-sectional view of the collection funnel of FIG. 9.

As shown in more detail in FIG. 10, the collection funnel 60 includes a recessed collection area 68 for collecting residual oil 70 or other liquids. The collection area 68 includes a flat bottom 72 for resting on a horizontal surface 74. The collection funnel is positioned in a vertically oriented configuration by resting surface 72 on surface 74 with, or without, the assistance of a flange 76. The width of the surface 72 is such that it may support the collection funnel in a vertically oriented position by itself.

Figure 8:
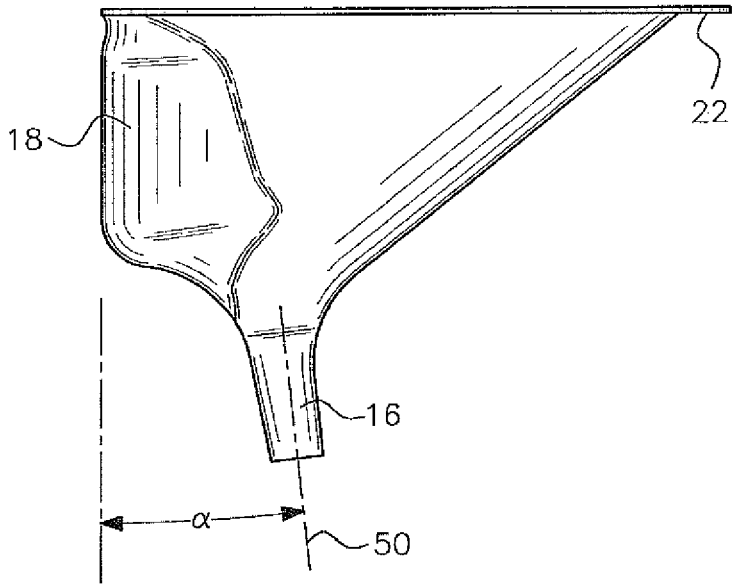
FIG. 8 is a side view of the collection funnel.

As similarly shown in FIGS. 2 and 8, the outlet spout 78 in FIG. 9 is positioned outwardly and upwardly at an angle of 10° to 20° with respect to the interior 80 of the collection funnel. This facilitates the drainage of liquids by gravity in the funnel into the recessed collection area 68. The residual liquids slide down the inclined slope of the outlet spout 78 in the direction of the recessed collection area 68.

Figure 11:
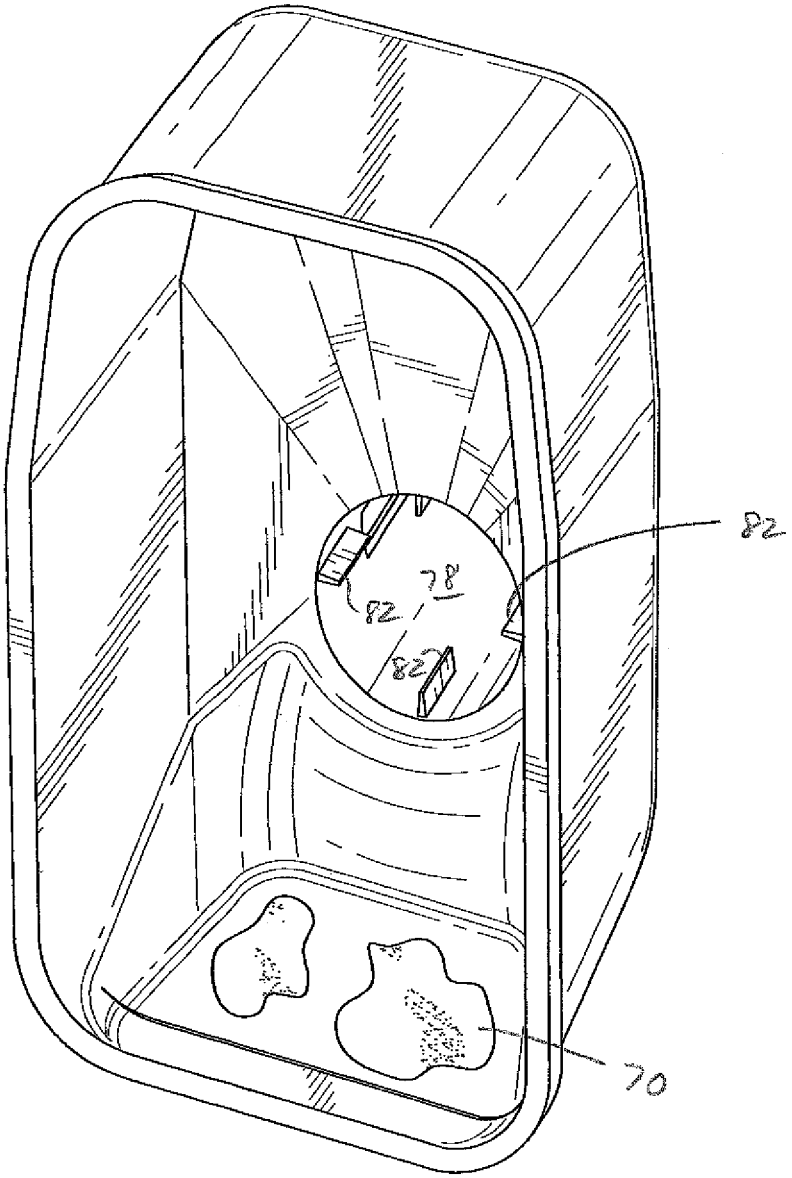
FIG. 11 illustrates a collection of residual oil within a collection area.
Figure 12:
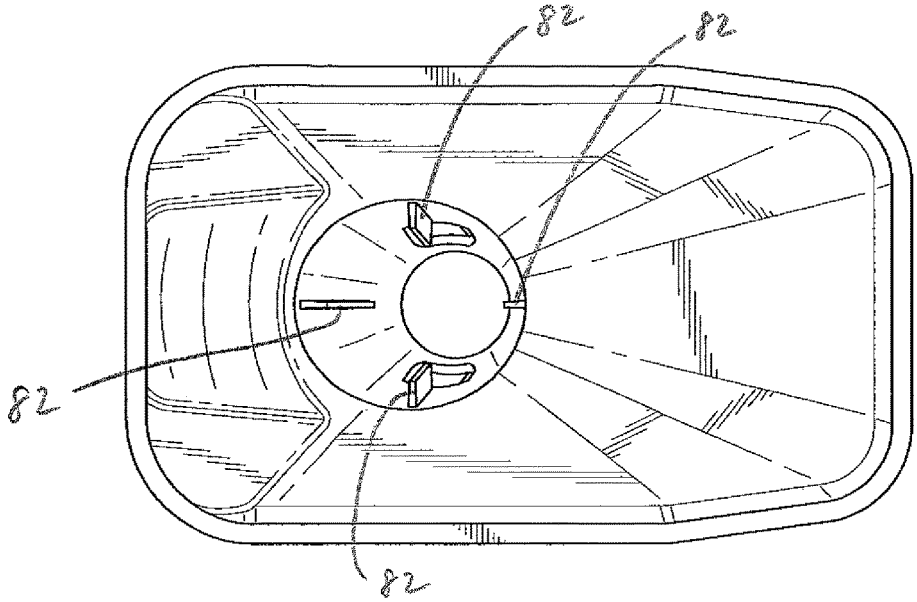
FIG. 12 is a top view of the collection funnel of FIG. 9.

As shown in FIG. 11, the interior of the collection spout includes a plurality of engagement fins 82 spaced about the periphery of the interior of the spout 78. These fins, numbering three or four, are equidistantly spaced about the interior of the spout so as to grab and hold in position the outlet spout of a container, such as oil container 62 shown in FIG. 9. The frictional fit between the oil container 62 and the fins 82 maintain the position of the container 62 as its contents are transferred to the outlet spout 78 of the collection funnel 60.

Figure 13:
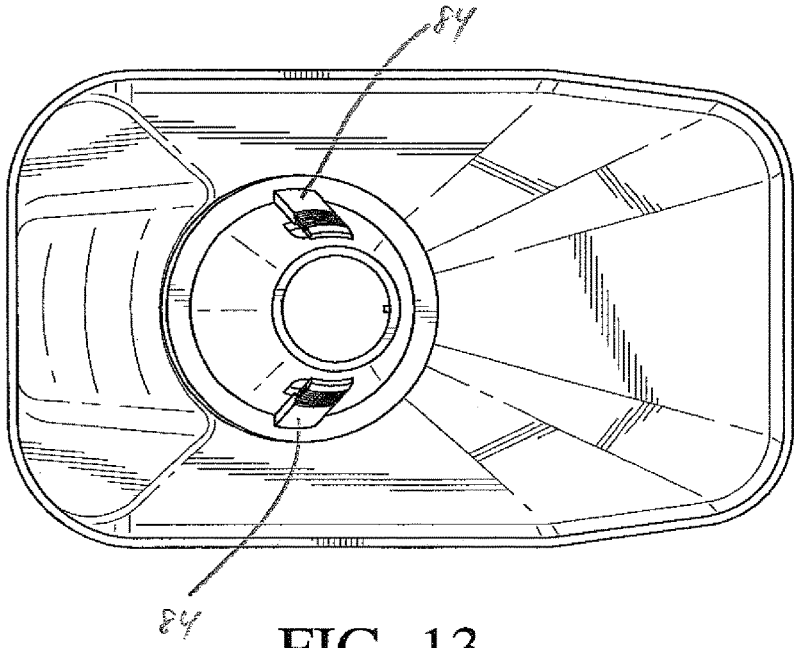
FIG. 13 is a bottom view of the collection funnel of FIG. 9.
Figure 14:
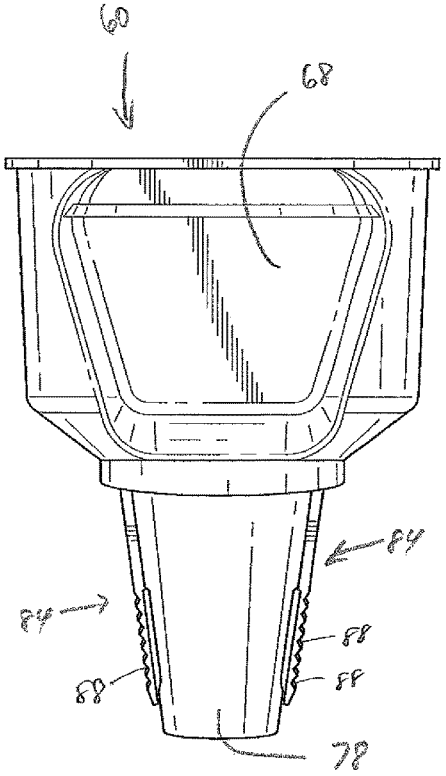
FIG. 14 is an end view of the collection funnel of FIG. 9.
Figure 15:
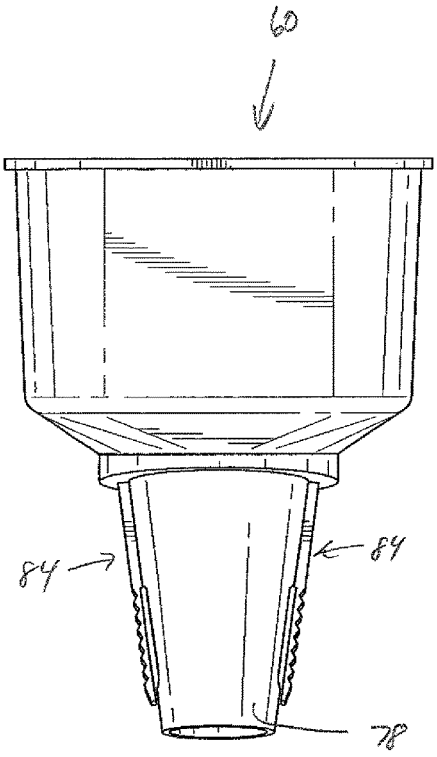
FIG. 15 is an opposite end view of the collection funnel from that shown in FIG. 14.

As shown in FIGS. 13, 14 and 15, the exterior surface of the outlet spout 78 includes a pair of diametrically opposed arms 84. As shown in FIGS. 14 and 15, the arms 84 are pivotally mounted at one end from an upper portion of the outlet spout. The remainder of the arms, terminating at its opposite end, is free to move inwardly towards openings 86 in a side wall of the outlet spout 78 so as to frictionally engage with the interior surface of an oil inlet port of an automobile engine. The arms 84 include a plurality of recessed ridges 88 which when forced into an inlet of an engine are caused to bend interiorly by the force of engagement with an interior diameter of the port upon insertion of the spout 78 into the oil inlet of an automobile engine. The width between the exterior surfaces of the arms is more than the interior diameter of the oil port.

These ridges grab the oil inlet of the engine and retain the collection funnel in place. The collection funnel simultaneously holds an oil container 62 by fins 82 for transfer of the contents of the container 62 into an automobile engine as shown in FIG. 9.

Figure 16:
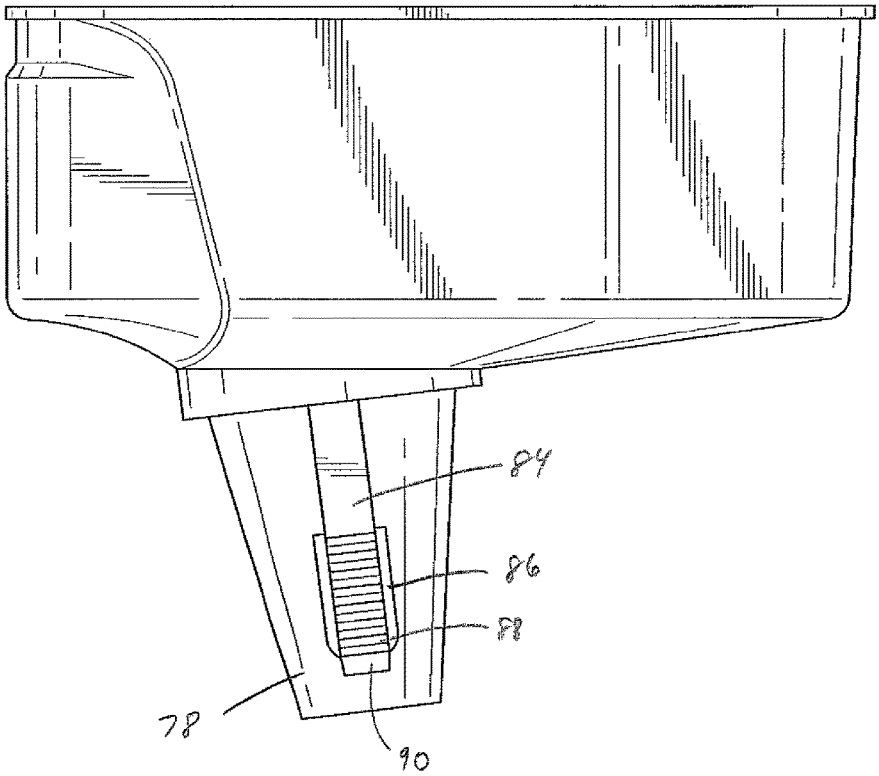
FIG. 16 is a side view of the collection funnel of FIG. 9.

As shown in FIG. 16, the lowermost free ends 90 of the arms 84 is restricted from passing into the interior of the spout 78, whereas the portion of the arms 84 including the ridges 88 are free to bend through the opening 86 into the interior of spout 78. This provides a rigid and secure holding of the collection funnel and the container 62 for transfer of oil into the engine.

Figure 17:
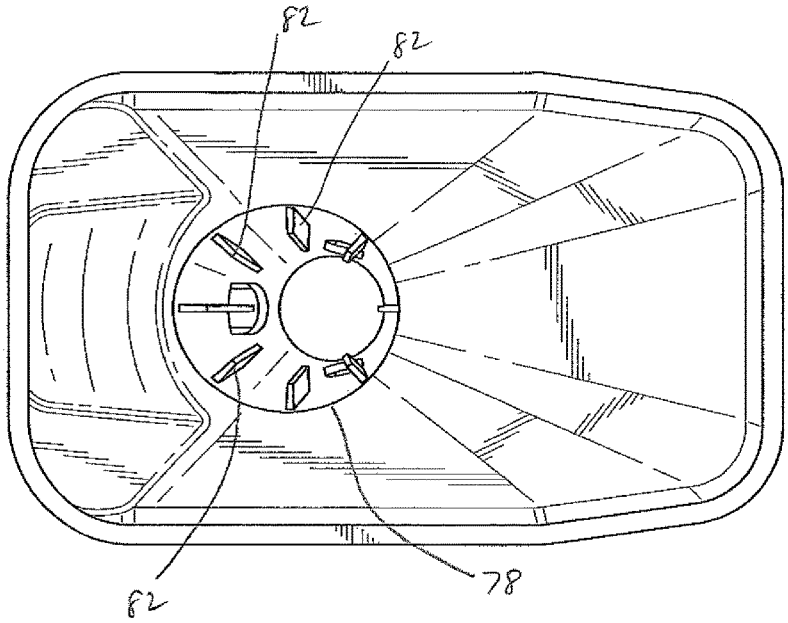
FIGS. 17 and 18 are a top view and a bottom view, respectively, of another alternate embodiment of the collection funnel of the present invention.
Figure 18:
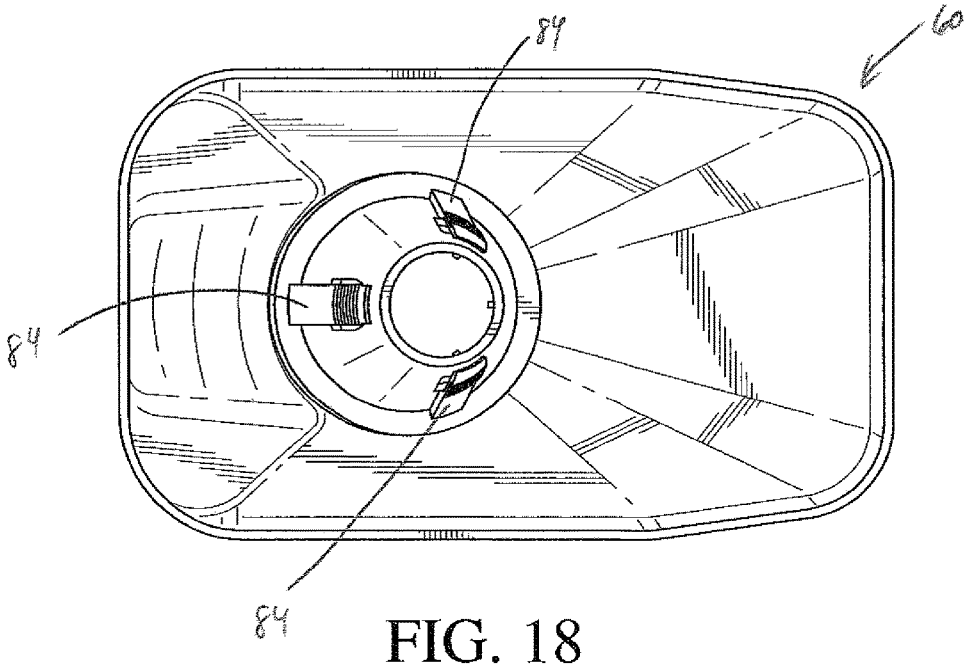

In the alternate embodiments of FIGS. 17 and 18, eight fins 82 are shown spaced around the interior periphery of the spout 78. In these figures, three arms 84 are used to secure the positioning of the collection funnel 60 in the oil port of an automobile engine. It is understood as being within the scope of the present invention that any type of engine can be used with the funnel of the present invention for transfer of oil from a container into an engine inlet port. It is also understood that the transfer of any liquids from one container into another container is contemplated as being within the scope of the present invention.

Figure 19:
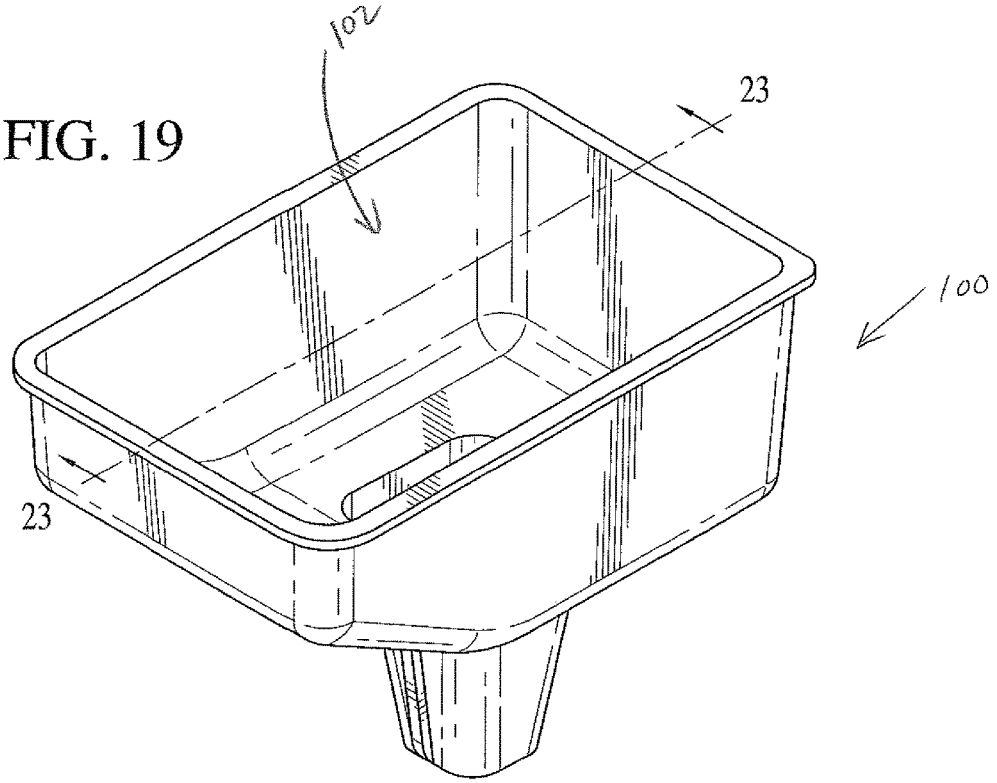
FIG. 19 is a perspective view of another alternate embodiment of the collection funnel of the present invention.
Figure 20:
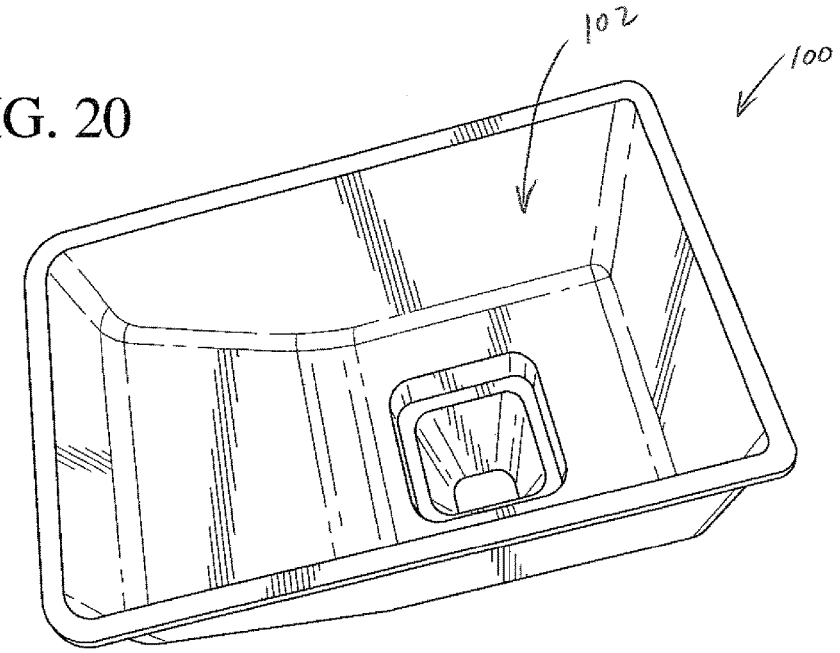
FIG. 20 is a top perspective view of FIG. 19.

In the alternate embodiment of FIGS. 19 through 26, an oil collection funnel 100 is shown. As shown in FIGS. 19 and 20, a large inlet opening area 102 is accessed from above. This inlet opening area 102 accommodates different sized oil containers.

Figure 21:
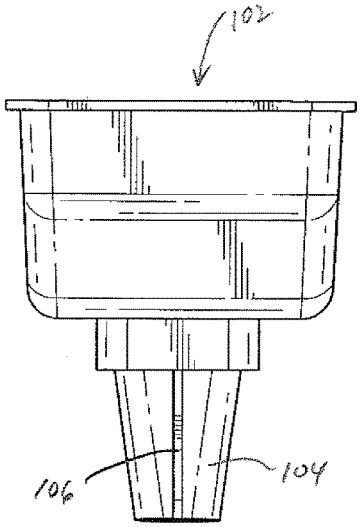
FIG. 21 is a front end view of FIG. 19.
Figure 22:
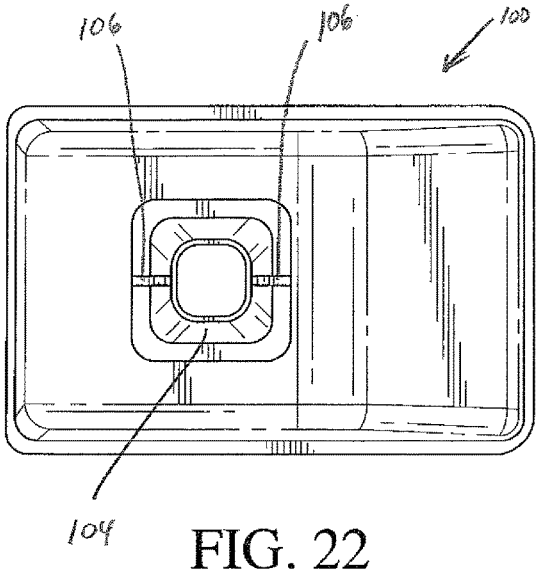
FIG. 22 is a bottom view of FIG. 19.
Figure 23:
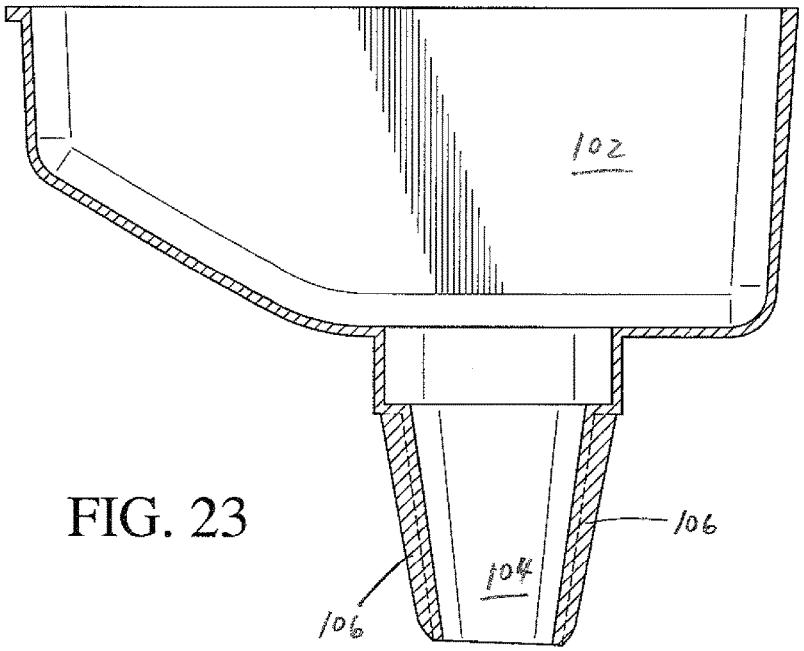
FIG. 23 is a sectional view taken along line 23-23 of FIG. 19.

As shown in FIGS. 21 and 22, the inlet opening 102 tapers down to a narrower outlet opening 104. The outlet opening 104 includes two laterally projecting side ribs 106 for engagement with an oil inlet pipe of an automobile.

Figure 24:
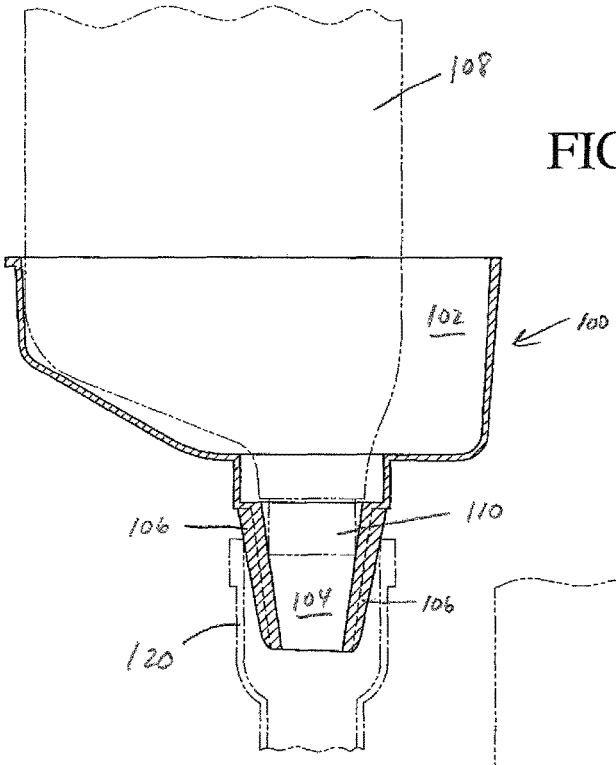
FIG. 24 illustrates a sectional view of the collection funnel being used to transfer liquids from an oil container to an oil inlet pipe of an automobile.
Figure 25:
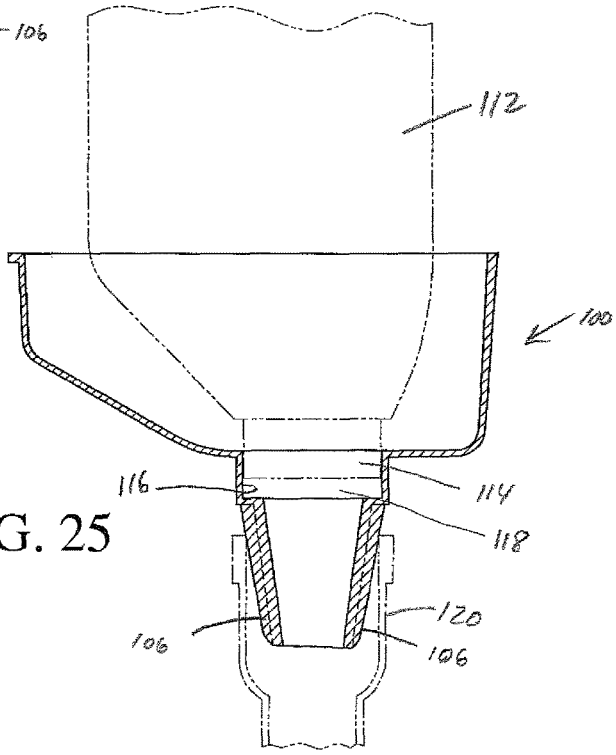
FIG. 25 illustrates a sectional view of the collection funnel being used with a different sized oil container to transfer liquids from the oil container to an oil inlet pipe of an automobile.

As shown in FIGS. 24 and 25, the collection funnel 100 is able to accommodate different sized oil containers. In FIG. 24, the oil container 108 is shown having its outlet 110 wedged into the tapering sidewalls of the outlet opening 104 of the oil collection funnel 100. The weight of the oil container 108 is supported by the sidewalls of the inlet opening 102.

In FIG. 25, a different sized oil container 112 has a different configured outlet 114. This outlet 114 is wedged into the side wall 116 of a stepped portion 118 of the oil collection funnel 100.

By this arrangement, the oil containers 108 and 112 are accommodated in the oil collection funnel 100 which has its outlet opening 104 wedged into an oil inlet port 120 of an automobile. Transfer of oil is thereby facilitated.

Figure 26:
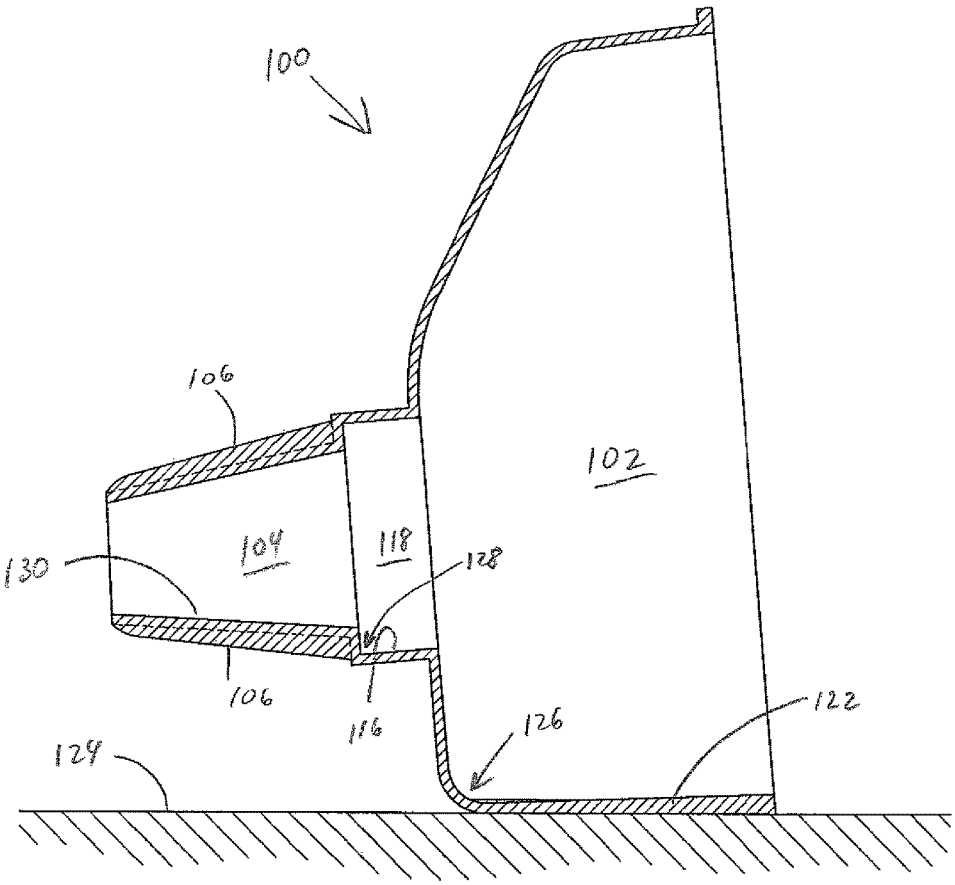
FIG. 26 is a sectional view of the collection funnel positioned on a horizontal surface so as to gather residual fluid in two collection areas.

In FIG. 26, the common attribute as in the other embodiments of the present invention is shown. Bottom wall 122 of the inlet opening 102 has a tapering thickness. When the oil collection funnel 100 is placed on a horizontal surface 124, due to the taper of bottom wall 122, residual oil is forced towards corner 126 by gravity.

Similarly, the downward slope of the wall 116 of stepped portion 118 causes residual oil to move along wall 116. The residual oil is collected in corner 128 due to the force of gravity. Also, due to the downward inclination of the interior wall 130 of outlet opening 104, residual oil is forced towards the stepped portion 118 for collection in the corner 128.

Thereby, the embodiment of FIGS. 19 through 26, facilitates collection of residual oil when the oil collection funnel 100 is placed on a horizontal surface. The inclination of the bottom wall 122, the wall 116 of the stepped portion 118 and the inclination of wall 130 towards stepped portion 118 provides the advantageous features of the present invention.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. A collection funnel comprising a body having an inlet opening and an outlet opening, the inlet opening and the outlet opening being aligned and open in diametrically opposite directions at opposite ends of the body, a recessed collection area in the body for receiving residual fluid, the recessed collection area being located between the inlet opening and the outlet opening of the body, the recessed collection area including a base having an outwardly facing surface, at least a portion of the base surface being flat, the base surface of the recessed collection area defining a surface for supporting the body when the body is positioned on a horizontal surface, the base surface of said recessed collection area being configured to extend parallel to the horizontal surface when the body is positioned on the horizontal surface, and the outlet opening extending at an upwardly and outwardly angle with respect to the base surface of the recessed collection area so that a central longitudinal axis of the outlet opening extends up and is inclined away from a plane of the base surface of the recessed collection area, the central longitudal axis of the outlet opening extends in the range of 10° to 20° with respect to the base surface, a plurality of fins spaced about and extending inwardly in a radial direction from an inner sidewall of the outlet opening for contacting and retaining in position an outlet portion of a container of fluid located within said body and projecting from said inlet opening so that fluid from the container is transferred through the outlet opening.

2. The collection funnel according to claim 1, wherein a surface of the body converges as the surface transitions toward the base surface of the recessed collection area.

3. The collection funnel according to claim 1, wherein the recessed collection area is located at one end of the body, and the body tapers from the recessed collection area towards an opposite end of the body for guiding residual fluid towards the recessed collection area when the body is in a vertical orientation.

4. The collection funnel according to claim 3, wherein an inclined surface extends from the outlet opening towards the opposite end of the body.

5. A collection funnel comprising a body having an inlet opening and an outlet opening, the inlet opening and the outlet opening being aligned and open in diametrically opposite directions at opposite ends of the body, a recessed collection area for residual fluid, the recessed collection area being located between the inlet opening and the outlet opening of the body, a base surface of said recessed collection area, at least a portion of the base surface being flat, the base surface of the recessed collection area defining a horizontal surface for supporting the body in a vertical orientation when the base surface is located on a horizontal surface, the outlet opening extending at an upwardly and outwardly angle with respect to the base surface of the recessed collection area so that a central longitudinal axis of the outlet opening extends up and is inclined away from a plane of the base surface of the recessed collection area, the central longitudal axis of the outlet opening extends in the range of 10° to 20° with respect to the base surface, a plurality of resiliently bendable arms, each of the plurality of arms including one end that is connected to and spaced about an exterior of the outlet opening, each of the plurality of arms including another end that is freely movable through a respective opening in the side wall of the outlet opening, the plurality of arms configured for frictionally engaging an inlet port so as to securely hold the body in the inlet port, and at least a portion of the plurality of arms are extendable through the plurality of respective openings in a side wall of the outlet opening in response to contact of the at least a portion of the plurality of arms with the inlet port.

6. The collection funnel according to claim 5, wherein the recessed collection area is located at one end of the body, and the body tapers from the recessed collection area towards an opposite end of the body for guiding residual fluid towards the recessed collection area when the body is in the vertical orientation.

7. The collection funnel according to claim 6, wherein an inclined surface extends from the outlet opening towards the opposite end of the body.

8. The collection funnel according to claim 5, wherein the plurality of arms include a plurality of ridges for frictionally securing the arms to the inlet opening.

9. The collection funnel according to claim 5, wherein there are two arms.

10. The collection funnel according to claim 5, wherein there are three arms.

* * * * *